US007976347B2

(12) United States Patent
Zhang

(10) Patent No.: US 7,976,347 B2
(45) Date of Patent: Jul. 12, 2011

(54) MULTIFUNCTIONAL ELECTRICAL CONNECTOR

(75) Inventor: Han-Ming Zhang, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/701,586

(22) Filed: Feb. 7, 2010

(65) Prior Publication Data

US 2010/0203767 A1 Aug. 12, 2010

(30) Foreign Application Priority Data

Feb. 7, 2009 (CN) ..... 2009 1 0300360

(51) Int. Cl.
*H01R 24/00* (2011.01)

(52) U.S. Cl. ..... 439/668

(58) Field of Classification Search ..... 439/668, 439/669, 188
See application file for complete search history.

(56) References Cited

U.S. PATENT DOCUMENTS

| | | | | |
|---|---|---|---|---|
| 4,060,887 | A * | 12/1977 | De Groef | 29/828 |
| 4,275,946 | A * | 6/1981 | Manina et al. | 439/188 |
| 4,846,719 | A * | 7/1989 | Iwashita | 439/63 |
| 4,938,717 | A * | 7/1990 | Lau | 439/669 |
| 5,574,815 | A * | 11/1996 | Kneeland | 385/101 |
| 6,106,486 | A * | 8/2000 | Tenerz et al. | 600/585 |
| 6,312,274 | B1 * | 11/2001 | Lin | 439/188 |
| 6,394,852 | B1 * | 5/2002 | Huang | 439/669 |
| 7,112,099 | B2 * | 9/2006 | Ma | 439/668 |
| 7,238,059 | B1 * | 7/2007 | Wu | 439/668 |
| 7,285,024 | B1 * | 10/2007 | Tai | 439/668 |
| 7,322,858 | B1 * | 1/2008 | Rogers et al. | 439/669 |
| 7,371,125 | B2 * | 5/2008 | McHugh et al. | 439/668 |
| 7,470,153 | B2 * | 12/2008 | Han et al. | 439/669 |
| 7,553,194 | B2 * | 6/2009 | Wang et al. | 439/668 |
| 7,553,195 | B2 * | 6/2009 | Matsumoto et al. | 439/669 |
| 7,604,513 | B2 * | 10/2009 | Wang et al. | 439/668 |
| 7,618,294 | B1 * | 11/2009 | Lin et al. | 439/669 |
| 7,699,665 | B1 * | 4/2010 | Yin | 439/669 |
| 7,717,755 | B2 * | 5/2010 | Zhang et al. | 439/669 |
| 7,753,738 | B2 * | 7/2010 | Zhang | 439/668 |
| 7,775,837 | B2 * | 8/2010 | Zhang | 439/669 |
| 7,824,230 | B1 * | 11/2010 | Ho | 439/669 |
| 2003/0100227 | A1 * | 5/2003 | Yeh | 439/668 |
| 2006/0046565 | A1 * | 3/2006 | Hosler | 439/578 |
| 2008/0032562 | A1 * | 2/2008 | McHugh et al. | 439/668 |
| 2008/0139043 | A1 * | 6/2008 | Wang et al. | 439/573 |
| 2008/0160835 | A1 * | 7/2008 | Chen et al. | 439/668 |
| 2008/0233805 | A1 * | 9/2008 | Wang et al. | 439/668 |
| 2008/0299835 | A1 * | 12/2008 | Lin et al. | 439/668 |
| 2008/0305667 | A1 * | 12/2008 | Zhang | 439/271 |
| 2009/0220196 | A1 * | 9/2009 | Daane et al. | 385/53 |
| 2009/0275245 | A1 * | 11/2009 | Zhang et al. | 439/701 |
| 2009/0311915 | A1 * | 12/2009 | Stiehl | 439/669 |
| 2010/0112871 | A1 * | 5/2010 | Yin | 439/669 |
| 2010/0144195 | A1 * | 6/2010 | Zhang | 439/541.5 |
| 2010/0173535 | A1 * | 7/2010 | Zhang | 439/733.1 |

* cited by examiner

*Primary Examiner* — T C Patel
*Assistant Examiner* — Vladimir Imas
(74) *Attorney, Agent, or Firm* — Andrew C. Cheng; Wei Te Chung; Ming Chieh Chang

(57) ABSTRACT

An electrical receptacle is provided and includes an insulative housing defining a first receiving space and a second space in communication with the first receiving space and a plurality of contacts comprising audio contacts, power contacts and at least one grounding contact. The audio contacts and the at least one grounding contact are received in the first receiving space and establish a path for transmitting audio signals, while the power contacts are received in the second receiving space and corporate with the at least one grounding contact to establish a path for power supply.

14 Claims, 8 Drawing Sheets

MULTIFUNCTIONAL ELECTRICAL CONNECTOR

BACKGROUND OF THE INVENTION

1. Field of the Invention

The present invention relates to an electrical connector, and more particularly to a receptacle connector transmitting not only signals, but also power.

2. Description of the Related Art

Communication devices, such as mobile phones, are being developed to be quickly interconnected to other devices while continuing to be portable with compact dimensions and reduced weight. Therefore, mobile phone manufacturers are squeezing their every once of ingenuity and stretching their utmost to design such that every component of the mobile phone can meet the grail: compact and light-weighted. At the same time manufacturers must ensure that all the electrical connections are good and reliable to maintain the quality and capability of signal transmission. The basic function of the mobile phone is to receive and transmit voice, and, more recently, images are also frequently transmitted after mobile phone is built-in with a camera, and the mobile phone has been used for surfacing through the Internet, however, no matter how many function may perform, it is limited by the capacity of the battery. As is well known, the mobile phone has an audio connector which receives a plug from an earphone, and also has a power connector which charges the battery. The mobile phone has to provide at least two real estates for incorporating those two connectors therein.

The mobile phone also is provided with an audio plug which is in a distal end of the ear phone for mating with the audio connector, and a power plug which mates with the power connector for power supply. That is to say, the manufacturers need provide two cable assemblies together with the mobile phone when the mobile phone is sold, which is not advantageous for reducing the cost. Hence, an improved electrical connector and an electrical plug are highly desired to overcome the aforementioned problem.

SUMMARY OF THE INVENTION

Accordingly, an object of the present invention is to provide a multifunctional receptacle connector.

In order to achieve the object set forth, a receptacle connector comprises an insulative housing defining a first receiving space and a second space in communication with the first receiving space and a plurality of contacts comprising audio contacts, power contacts and at least one grounding contact. The audio contacts and the at least one grounding contact are received in the first receiving space, while the power contacts are received in the second receiving space.

Other objects, advantages and novel features of the invention will become more apparent from the following detailed description of the present embodiment when taken in conjunction with the accompanying drawings.

DETAILED DESCRIPTION OF THE INVENTION

Figure 1:
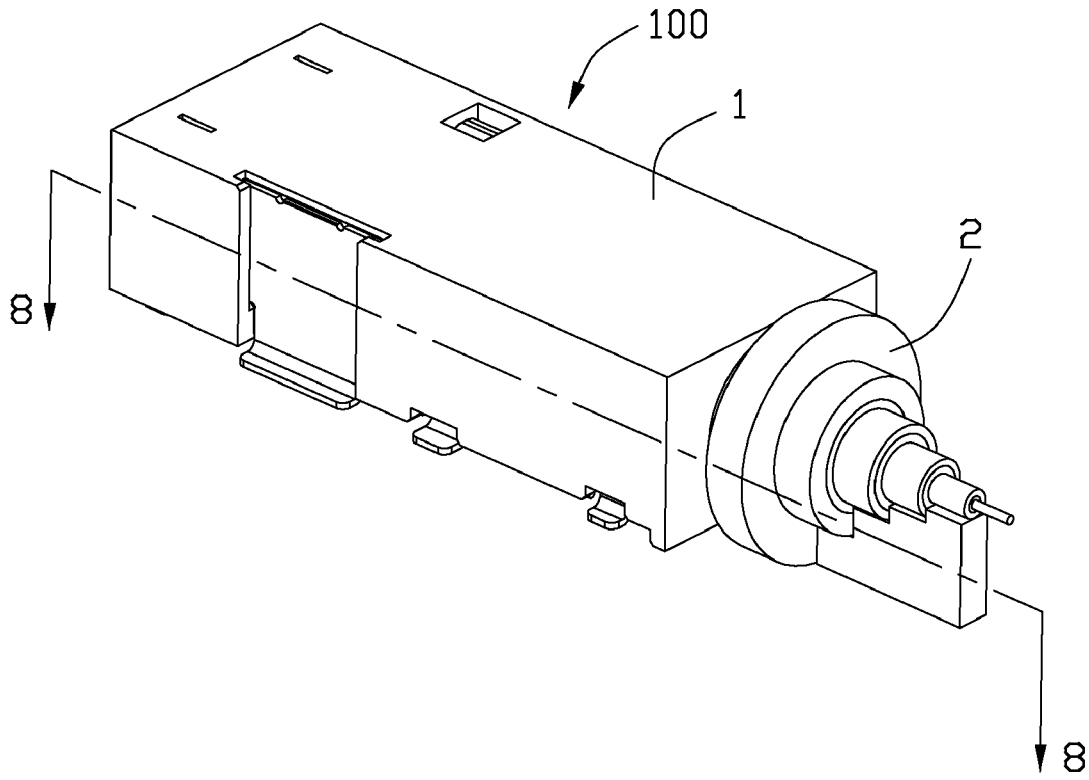
FIG. 1 is a perspective view of an electrical receptacle mating with an electrical plug in accordance with the present invention.
Figure 2:
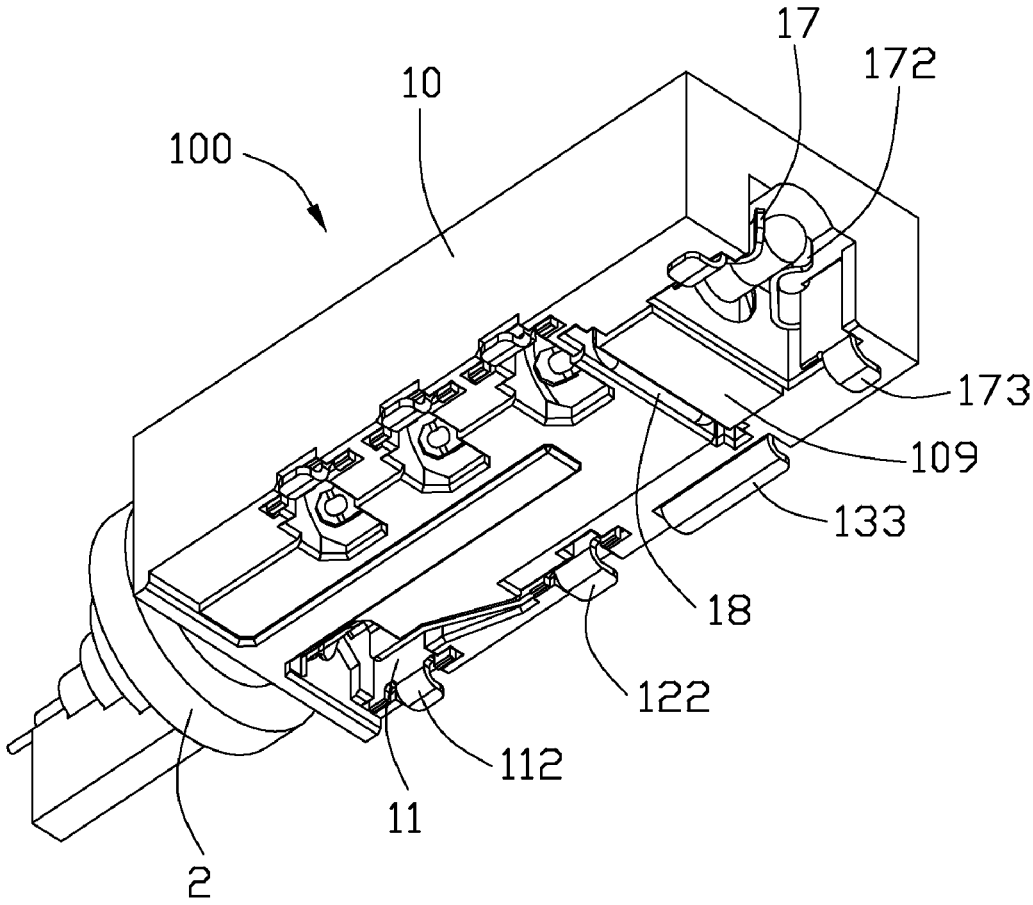
FIG. 2 is another perspective view of the electrical receptacle mating with the electrical plug shown in FIG. 1.

Reference will now be made to the drawing figures to describe a preferred embodiment of the present invention in detail. Referring to FIGS. 1 and 2, an electrical connector assembly 100 according to the preferred embodiment of the present invention is provided and comprises an electrical receptacle 1 and an electrical plug 2 mating with said receptacle. The electrical receptacle 1 is assembled onto a periphery of an electronic device and the detailed configuration will be described hereafter.

Figure 3:
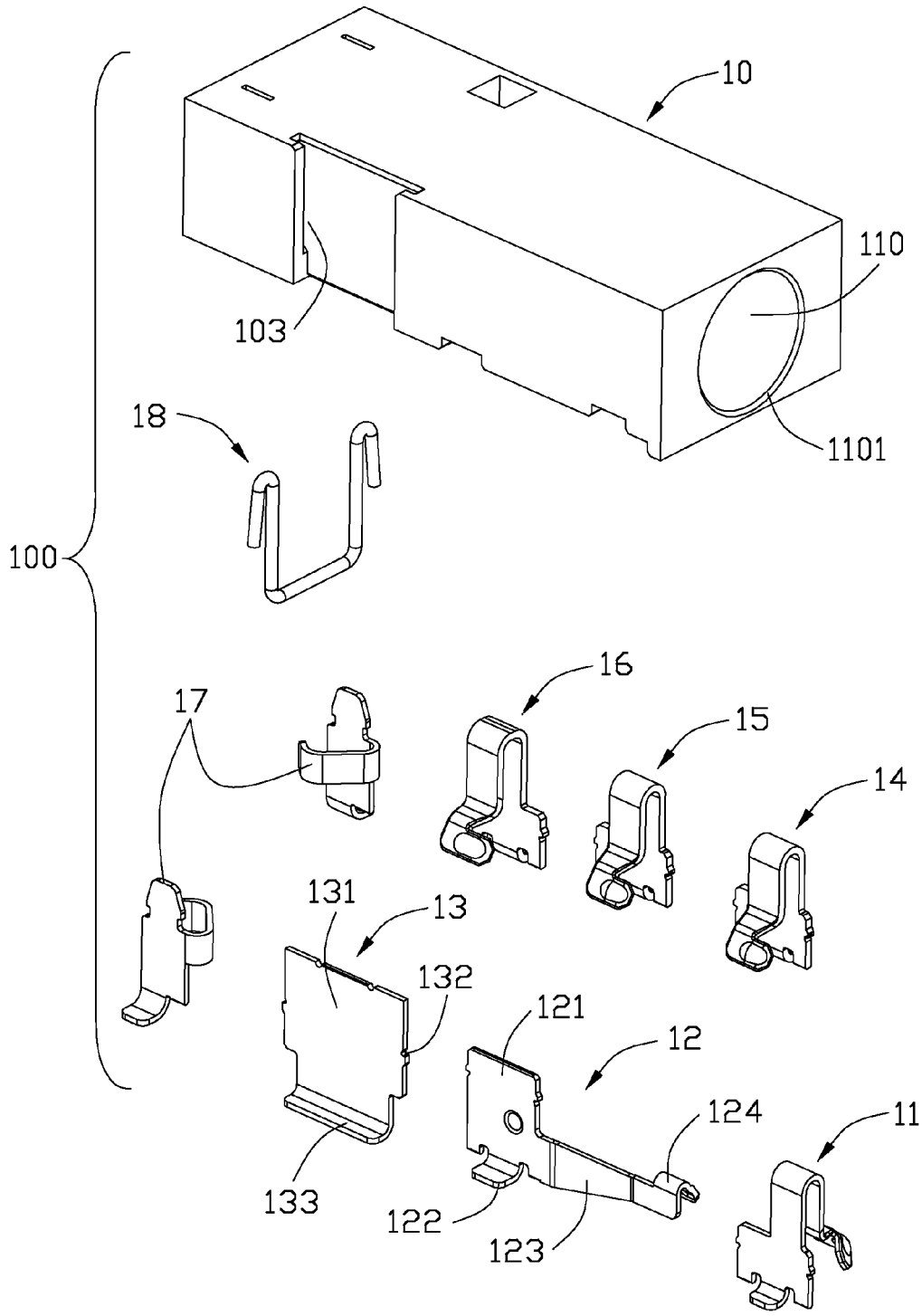
FIG. 3 is an exploded perspective view of the electrical receptacle shown in FIG. 1.
Figure 4:
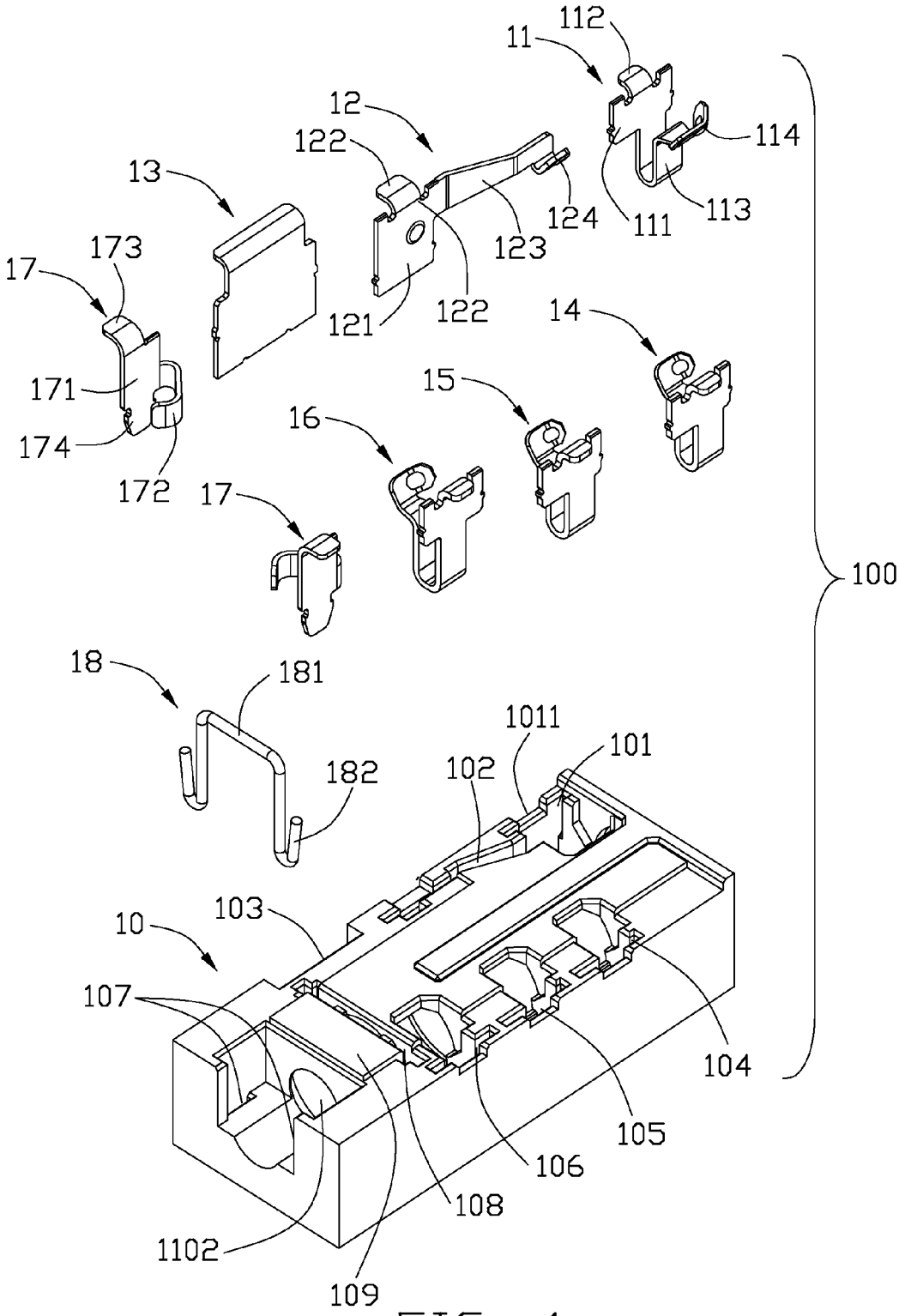
FIG. 4 is another perspective view of the electrical receptacle shown in FIG. 1.

Referring to FIGS. 3 and 4, the electrical receptacle 1 comprises a rectangular insulative housing 10 and a plurality of contacts and retaining members received therein. The insulative housing 10 defines a circular receiving space 110 extending along a front-to-rear direction and creates a front opening 1101 and a rear opening 1102 at opposite ends thereof. A first groove 101, a second groove 102, a third groove 103, a fourth groove 104, a fifth groove 105, a sixth groove 106, a eighth groove 108 and a pair of seventh grooves 107 are respective defined at opposite sides of the receiving space 110 and arranged side-by-side along the front-to-rear direction. The contacts comprises a first contact 11, a second contact 12, a third contact 13, a fourth contact 14, a fifth contact 15, a sixth contact 16 and a pair of seventh contacts 17 each received in the corresponding groove. The retaining member comprises a first retaining member 13 and a second retaining member 18.

The first groove 101 runs through a bottom wall of the insulative housing 10 along the front-to-rear direction and is located besides and in communication with the receiving space 110. The first groove 101 is located adjacent to the front opening 1101 and defines an aperture 1011 at a lateral edge thereof. The first contact 11 is designated and served as a grounding contact and comprises a plate-shaped body portion 111 with a plurality of bars at opposite sides thereof. The first contact 11 is inserted into the first groove 101 from the bottom wall of the insulative housing 10 with the tips interfering with the insulative housing. A resilient connecting portion 113 extends from one end of the body portion 111 upwardly and then downwardly so as to form a curved configuration, on a distal end of which, a contacting portion 114 protrudes outwardly and projects into the receiving space 110. On the other end of the body portion 111, a solder portion 112 perpendicularly extends outwardly and is received in the aperture 1011.

The second groove 102 connects with the first groove 101 and extends along the front-to-rear direction. The second contact 12 is received in the second groove 102 and designated as a switching contact for cooperating with the first contact 11 so as to form a switch. The second contact 12 has a rectangular body portion 121, an elongated connecting portion 123 extending forward from a side edge of the body portion 121 and a solder portion 122 extending from a bottom edge of the body portion 121. A contacting portion 124 is bent outwardly from an upper edge of the connecting portion 123 and exposes in the mating space 110.

The third groove 103 is defined at a lateral edge of the insulative housing 10 behind the second groove 102 and runs through the insulative housing 10 downwardly for receiving the first retaining member 13 therein. The first retaining member 13 comprises a body portion 131, a plurality of bars 132 at opposite sides of the body portion 131 and a solder portion 133 extending from a bottom edge of the body portion 131. The first retaining member 13 can increase the retaining force when the electrical receptacle 1 is mounted onto a printed circuit board.

The fourth, fifth and sixth grooves 104, 105, 106 are defined at the other side of the mating space 110 and arranged along the front-to-rear direction. The fourth, fifth and sixth contacts 14, 15, 16 are designated as the same configuration comparing with the first contact 11 and respectively received in the fourth, fifth and sixth grooves 104, 105, 106. The fourth, fifth and sixth contacts 14, 15, 16 are arranged as audio contacts, particularly, the fourth contact 14 is designated and served as microphone contact, the fifth contact 15 is designated as right channel contact, and the sixth contact 16 is designated and served as left channel contact.

The eighth groove 108 is located between the rear opening 1102 and the sixth groove 105 and runs through the bottom wall along a transverse direction perpendicular to the front-to-rear direction. The second retaining member 18 is inserted into the sixth groove 105 and rides on the mating space 110. The second retaining member 18 is made by bending a metallic tinsel, and comprises a connecting portion 181 and a pair of locking portions 182 perpendicularly extending from opposite sides of said connecting portion 181 and bending backwardly at a distal end thereof. The second retaining member 18 engages with the electrical plug 2 for increasing the interfering force when the electrical plug 2 is inserted into the mating space 110.

A partition portion 109 is defined behind the eighth groove 108 and the rear opening 1102 is formed on the partition portion 109 and in communication with the mating space 110. The dimension of the rear opening 1102 is smaller than that of the front opening 1101, therefore, the electrical plug 2 which can only be received in the front opening 1101 can not pass through the rear opening 1102 and will be blocked by the partition portion 109. The partition portion 109 divides the mating space 110 into a front mating space and a rear mating space.

The pair of seventh grooves 107 are respectively defined at opposite sides of the rear mating space for receiving the seventh contacts 17 therein. The seventh contacts 17 are designated as power contacts and each comprises a body portion 171, a retaining portion 174 straightly extending downward from the body portion 171, a contacting portion 172 extending outward from a lateral edge of the body portion 171, and a solder portion 173 perpendicular extending outward from one end of the body portion 171.

The first, second, fourth, fifth, sixth contacts 11, 12, 14, 15, 16 (generally designated as audio contacts) and the first and second retaining members 13, 18, which are received in the front mating space and located in front of the partition portion 109, form a standard audio jack. A standard audio plug can insert into the front mating space and contact with the audio contacts for transmitting audio signals. Moreover, the first contact 11, which is designated as the grounding contact, together with the power contacts 17 form a perfectly path for power supply. That is to say, the electrical receptacle 1 can not only contact with a standard audio plug for transmitting audio signals, but also in contact with a power plug for providing power supply, which is beneficial for the manufacturers to reduce the size of the electronic devices and control the manufacturing cost. As the dimension of the rear opening 1102 is smaller than that of the front opening 1101, the standard audio plug can not contact with the power contacts 17.

Figure 5:
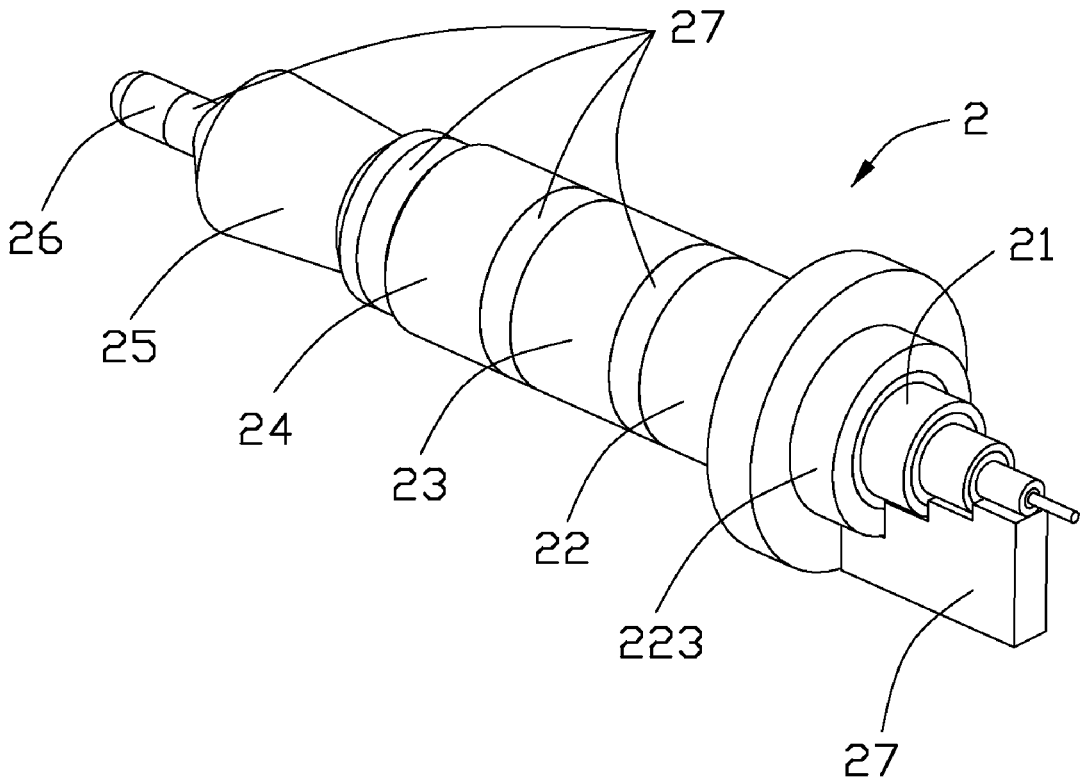
FIG. 5 is a perspective view of the electrical plug shown in FIG. 1.
Figure 6:
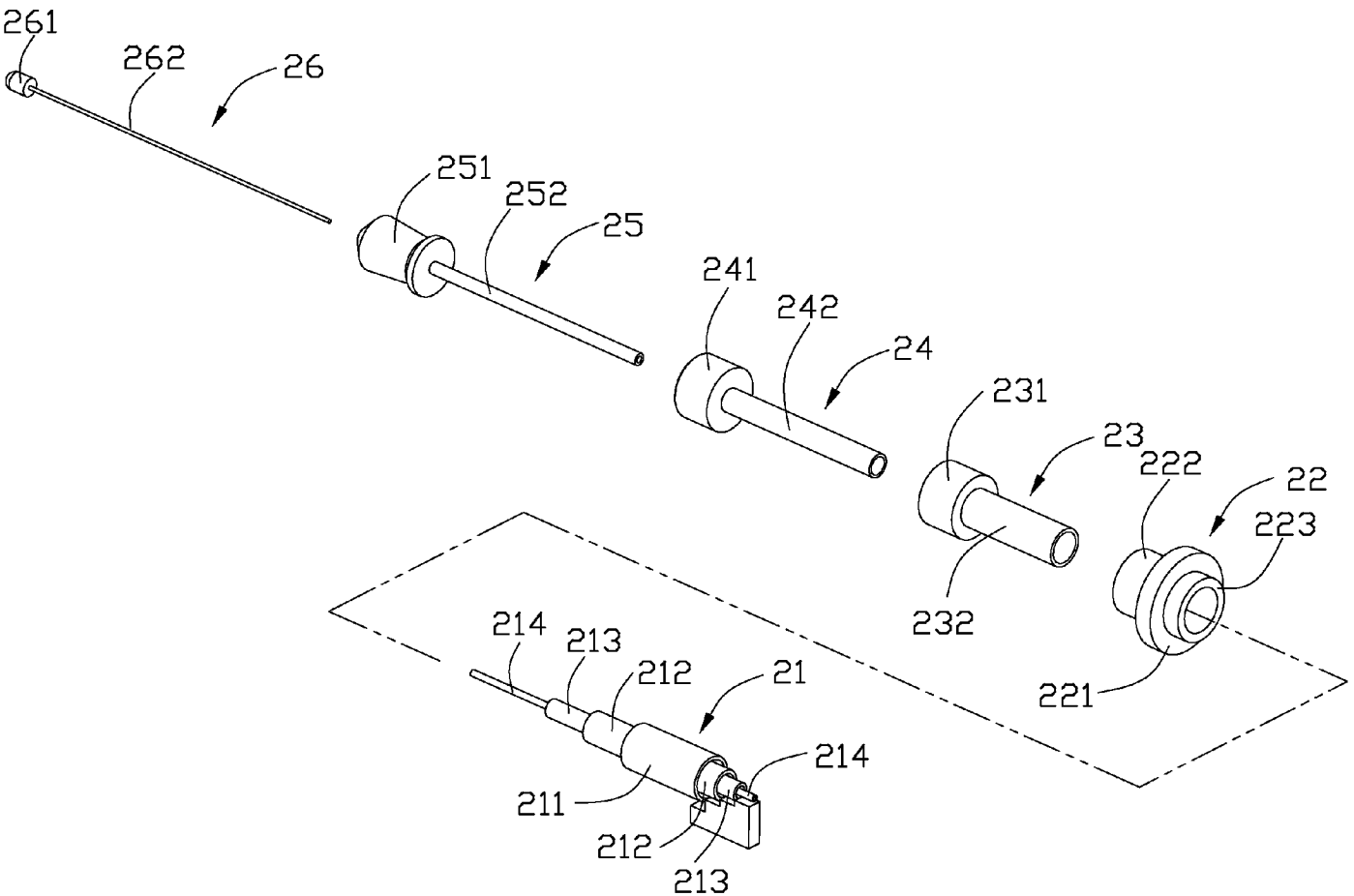
FIG. 6 is an exploded perspective view of the electrical plug shown in FIG. 1.
Figure 7:
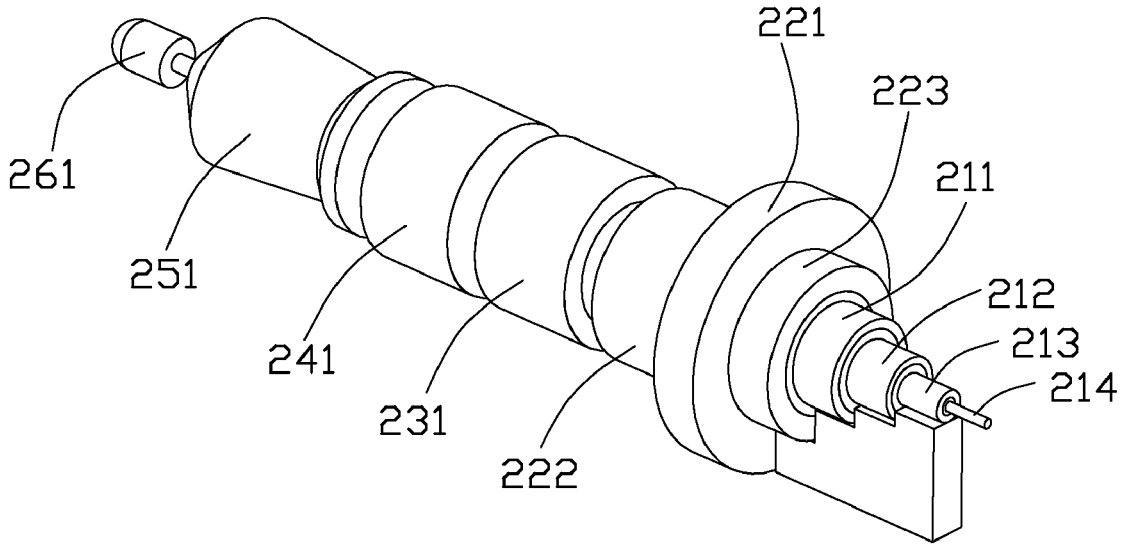
FIG. 7 is an exploded perspective view of the electrical plug shown in FIG. 1 without the insulative housing enclosing thereon.

Referring to FIGS. 5 and 6, the electrical plug 2 is in a cylindrical shape and comprises a plurality of sleeves stacked together. The electrical plug 2 comprises a first contacting member 26, a second contacting member 25, a first sleeve 24, a second sleeve 23, a third sleeve 22 and a binding post 21.

The binding post 21 comprises four individual binding sleeves, which are designated as a first binding sleeve 211 in an outmost circle and having a shortest length, a second binding sleeve 212 inside the first binding sleeve 211 and longer than the first binding sleeve 211, a third binding sleeve 213 inside the second binding sleeve 212 and longer than the second binding sleeve 212, and a fourth binding sleeve 214 inside the third binding sleeve 213 and longer than the third binding sleeve 213. Insulators are filled between the adjacent binding sleeves and separate them from each other. Each binding sleeve is connected with a cable for transmitting different signals.

The first contacting member 26 comprises an elongated first connecting portion 262 and a columnlike first contacting portion 261 disposed at a front end of the first connecting portion 262. The second contacting member 25 comprises an elongated second connecting portion 252 and a columnlike second contacting portion 251 disposed at a front end of the connecting portion 252, wherein the diameter of the second contacting portion 251 is much bigger than that of the first contacting portion 261. The second contacting member 25 is configured into a hollowed structure and defines an opening for the first connecting portion 262 to pass through. The first sleeve 24 and a second sleeve 23 respectively form a cylindrical conduct portion 241, 231 and a pipe 242, 232 connected with the conduct portion. The third sleeve 22 is also a hollowed structure and comprises a middle body portion 221 and a conduct portion 222 and a pipe 223 at opposite ends of the body portion 221. The diameter of the body portion 221 is bigger than those of the conduct portion 222 and the pipe 223.

The third sleeve 22 is slipping over the binding post 21, and the pipe 223 is located outside the first binding post 211 for connecting with a grounding cable. The pipe 232 of the second sleeve 23 passes through the conduct portion 222 and the pipe 223, and depends on the first binding post 211, to which a microphone cable is terminated thereon. The diameter of the first binding post 211 is nearer to that of the pipe 232 of the second sleeve 23. Similarly, the first sleeve 24 inserts into the second sleeve 23 and the pipe 242 depends on the second binding post 212, to which a right channel cable is connected thereon. The second contacting member 25 inserts into the first sleeve 24 and depends on the third binding post 213, to which a left channel cable is connected thereon. The first contacting member 26 inserts into the second contacting member 25 and depends on the fourth binding post 214, to which a cable for transmitting power is connected thereon. After the above procedure is accomplished, every adjacent members are apart from each other, then insulators 27 are filled therebetween so as to form the electrical plug 2 as shown in FIG. 8.

Before the first contacting member 26 is inserted into the second contacting member 25, the electrical plug 2 works as a standard audio plug. After the first contacting member 26 is inserted therein, the first contacting member 26 and the third sleeve 22 can respectively act as a positive anode and a negative cathode of a power plug, that is to say, the electrical plug 2 can also be used as a power plug for power supply. This multiple function electrical plug can reduce the number of the accessories brought by electronic device, which is beneficial for reducing the cost of the electronic device.

Figure 8:
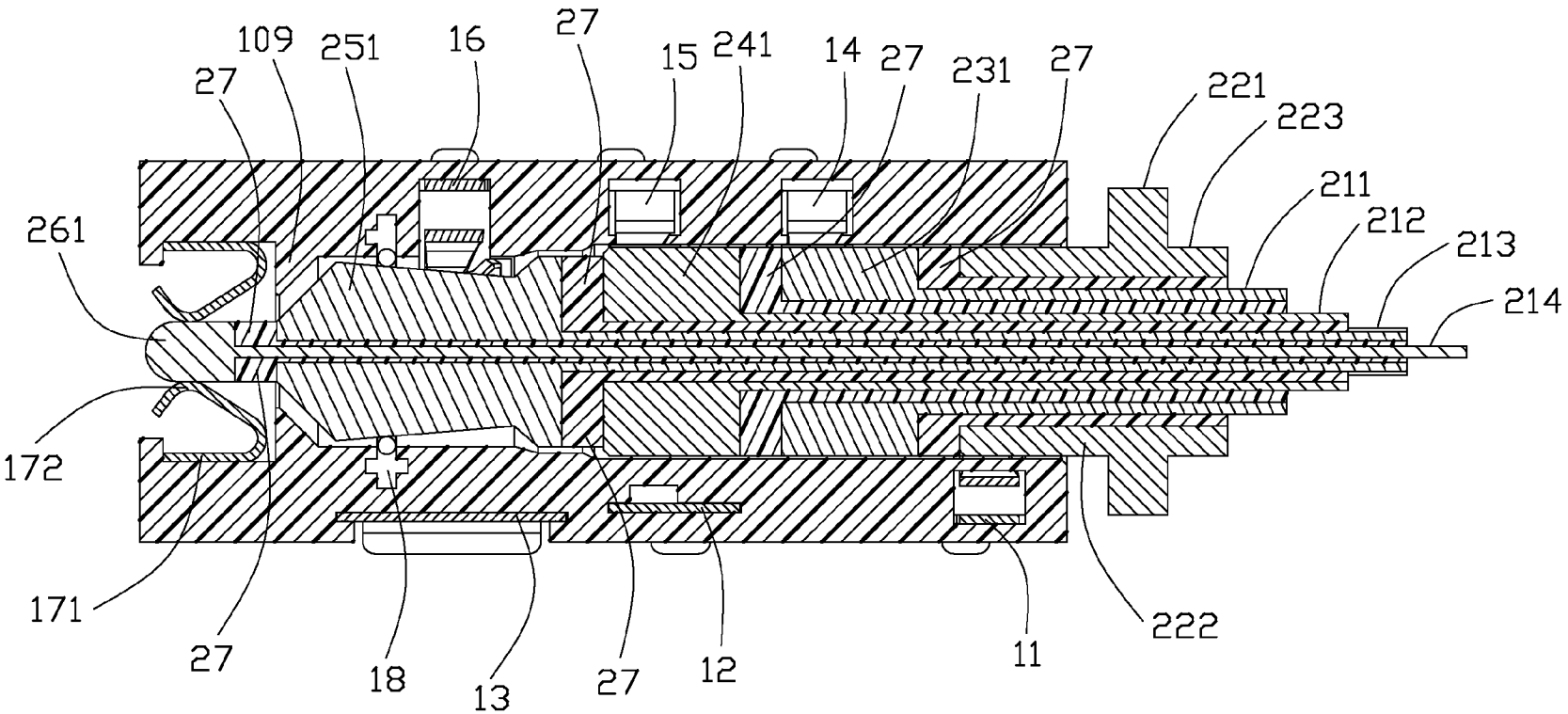
FIG. 8 is cross sectional view of the electrical receptacle mating with the electrical plug shown in FIG. 1 along line 8-8.

Referring to FIG. 8, when the electrical plug 2 is inserted into the receiving space 110, the contacting portion 114 moves inwardly to contact with the contacting portion 124 of the second contact 12, and a control signal will be generated and sent to the electronic device to turn off the inside-built loudspeaker. With the further movement of the electrical plug, firstly, the right channel contact 15 and the left channel contact 16 will then in contact with the conduct portion 241 of the first sleeve 24 and the contacting portion 251 of the second contacting member 25, then, the microphone contact 14 contact with the conduct portion 231 of the second sleeve 23, and lastly the grounding contact 11 contact with the conduct portion 222 of the third sleeve 22. At this moment, audio signal transmission is successfully accomplished. As the dimension of the second contacting member 25 is larger than that of the rear opening 1102, the second contacting member 25 will be stopped in front of the partition portion 109. However, as the dimension of the first contacting member 26 is smaller than that of the rear opening 1102, the first contacting member 26 inserts into the rear mating space and contact with the power contacts 17, therefore a power supply function is also accomplished right now. That is to say, users can enjoy the music in the electronic device by the audio transmission path established by the electrical connector assembly, at the same time, the electronic device can also be charged by the power transmission path established by the electrical connector assembly. If a signal function is needed, a control device can be arranged into the electrical connector assembly to choose the needed path.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical receptacle comprising:

an insulative housing defining a first receiving space and a second space in communication with the first receiving space; and a plurality of contacts comprising audio contacts, power contacts and at least one grounding contact;

wherein the audio contacts and the at least one grounding contact are received in the first receiving space, while the power contacts are received in the second receiving space;

wherein the audio contacts and the power contacts use the same at least one grounding contact to respectively establish an audio transmission path and a power supply path.

2. The electrical receptacle as described in claim 1, wherein a partition portion is formed between the first and second receiving spaces, the first receiving space extends along a front-to-rear direction and defines a front opening and a rear opening in different dimensions thereof, said rear opening is defined on the partition portion.

3. The electrical receptacle as described in claim 2, wherein the at least one grounding contact is disposed adjacent to the front opening, said audio contacts are disposed opposite to the at least one grounding contact.

4. The electrical receptacle as described in claim 3, further comprising a switch contact disposed at the same side of the at least one grounding contact and cooperating with the at least one grounding contact to form a switch.

5. The electrical receptacle as described in claim 4, further comprising a retaining member, which comprises a connecting portion riding on the first receiving space and a pair of locking portions projecting into the first receiving space.

6. The electrical receptacle as described in claim 2, wherein a pair of grooves are defined at opposite sides of the second receiving space for receiving said power contacts.

7. An electrical connector assembly comprising:

a first connector including:

a first insulative housing defining an elongated receiving space with a front opening in a front face of the first housing for insertion of a second connector therein;

a narrowed passage formed in a rear portion of the first housing to communicate said receiving space with an exterior;

a plurality of first signal contacts disposed in the housing with contacting sections essentially located on a periphery of said elongated receiving space; and a first power contact with a contacting portion disposed in the rear portion of the first housing outside of said narrowed passage; wherein the first power contact is essentially axially located behind and segregated from the first signal contacts under condition that the contacting sections of the first signal contacts are essentially located axially in front of the contacting portion of the first power contact.

8. The electrical connector assembly as claimed in claim 7, the second connector includes a second insulative housing arranged in a columnar manner comprising a plurality of coaxial sleeves radially separated by a plurality of second signal contacts; wherein said second connector defines along a center axis a second power contact under condition that the second connector is inserted into the first connector through the front opening wherein the second housing is received in the receiving space with the second signal contacts mechanically and electrically contact the corresponding first signal contacts, respectively, and with the second power contact extending through the narrowed opening and mechanically and electrically contacts the first power contact.

9. The electrical connector assembly as claimed in claim 8, wherein a retaining member is disposed in the first housing behind the signal contacts while in front of the first power contact to retain the inserted second connector in position.

10. The electrical connector assembly as claimed in claim 7, wherein at least one grounding contact is disposed in the elongated receiving space and used as a grounding path not only for the first signal contacts but also for the first power contact.

11. An electrical connector assembly comprising:

a plug connector including a plug insulative housing arranged in a columnar manner comprising a plurality of coaxial sleeves radially separated by a plurality of plug signal contacts;

a plug power contact acting as a positive anode located at the innermost of the plug insulative housing and projecting toward a front end of the plug connector along a center axis; and a plug grounding contact acting as a negative cathode located at the outmost of the plug insulative housing and closer to a rear end of the plug connector along the center axis;

wherein said plug signal contacts together with the plug grounding contact form a standard audio plug.

12. The electrical connector assembly as described in claim 11, further comprises a receptacle connector including a receptacle insulative housing defining a first receiving space and a second space in communication with the first receiving space, a plurality of receptacle audio contacts and at least one receptacle grounding contact received in the first receiving space to mechanically and electrically contact with the plug signal contacts and plug grounding contact, and receptacle power contacts received in the second receiving space to mechanically and electrically contact with the plug power contact.

13. The electrical connector assembly as claimed in claim 12, wherein a partition wall is located axially between the first receiving space and the second receiving space to axially separate said first receiving space and said second receiving space.

14. The electrical connector assembly as claimed in claim 13, wherein said partition wall defines a passage which is diametrically dimensioned to only allow the plug power contact to extend therethrough.

* * * * *